US010381725B2

(12) United States Patent
Iancu et al.

(10) Patent No.: US 10,381,725 B2
(45) Date of Patent: Aug. 13, 2019

(54) MONOLITHIC DUAL BAND ANTENNA

(71) Applicant: Optimum Semiconductor Technologies, Inc., Tarrytown, NY (US)

(72) Inventors: Sabin Daniel Iancu, Pleasantville, NY (US); Surducan Emanoil, Cluj-Napoca (RO); Surducan Vasile, Cluj-Napoca (RO)

(73) Assignee: OPTIMUM SEMICONDUCTOR TECHNOLOGIES INC., Tarrytown, NY (US)

( * ) Notice: Subject to any disclaimer, the term of this patent is extended or adjusted under 35 U.S.C. 154(b) by 350 days.

(21) Appl. No.: 15/141,011

(22) Filed: Apr. 28, 2016

(65) Prior Publication Data

US 2017/0025757 A1 Jan. 26, 2017

Related U.S. Application Data

(60) Provisional application No. 62/194,552, filed on Jul. 20, 2015.

(51) Int. Cl.

| | |
|---|---|
| ***H01Q 5/30*** | (2015.01) |
| ***H01Q 3/36*** | (2006.01) |
| ***H01Q 3/38*** | (2006.01) |
| ***H01Q 21/00*** | (2006.01) |
| ***H01Q 21/06*** | (2006.01) |
| *H01Q 1/24* | (2006.01) |
| *H01Q 9/04* | (2006.01) |
| *H01Q 21/28* | (2006.01) |

(Continued)

(52) U.S. Cl.

CPC ..... *H01Q 5/30* (2015.01); *H01Q 3/36* (2013.01); *H01Q 3/38* (2013.01); *H01Q 21/0093* (2013.01); *H01Q 21/065* (2013.01); *H01Q 1/243* (2013.01); *H01Q 5/40* (2015.01); *H01Q 9/0407* (2013.01); *H01Q 9/0414* (2013.01); *H01Q 21/28* (2013.01); *H01Q 23/00* (2013.01)

(58) Field of Classification Search

CPC ..... H01Q 5/30; H01Q 5/307; H01Q 5/328; H01Q 3/30; H01Q 3/38; H01Q 3/26; H01Q 21/0093; H01Q 21/08; H01Q 21/28

USPC ..... 342/372, 700; 343/700

See application file for complete search history.

(56) References Cited

U.S. PATENT DOCUMENTS 5,055,852 A 10/1991 Dusseux
5,087,922 A * 2/1992 Tang ..... H01Q 21/062 343/795

(Continued)

OTHER PUBLICATIONS

International Search Report and Written Opinion dated Jul. 19, 2016 for PCT/US16/42911.

(Continued)

*Primary Examiner* — Chuong P Nguyen

(74) *Attorney, Agent, or Firm* — Zhong Law, LLC

(57) ABSTRACT

A monolithic dual band antenna is provided. The monolithic dual band antenna includes a first layer comprising a high frequency band antenna. The monolithic dual band antenna further includes a second layer underlying the first layer. The second layer includes a low frequency band antenna. The geometry of the high frequency antenna relative to the low frequency antenna causes resulting electric fields of the high frequency band antenna to be orthogonal to the resulting electric fields of the low frequency band antenna.

19 Claims, 10 Drawing Sheets

(51) Int. Cl.
*H01Q 5/40* (2015.01)
*H01Q 23/00* (2006.01)

(56) References Cited

U.S. PATENT DOCUMENTS 6,771,221 B2 * 8/2004 Rawnick ..... H01Q 9/0414 343/700 MS
6,995,720 B2 * 2/2006 Shikata ..... H01Q 9/0421 343/700 MS
7,746,276 B2 * 6/2010 Surducan ..... H01Q 1/38 343/700 MS
7,995,000 B2 * 8/2011 Manasson ..... H01Q 3/24 343/700 MS
8,059,049 B2 * 11/2011 Quan ..... H01Q 1/085 343/700 MS
8,269,676 B2 * 9/2012 Lin ..... H01Q 1/243 343/700 MS
8,294,622 B2 * 10/2012 Amari ..... H01Q 1/243 343/702
9,379,440 B2 * 6/2016 Onaka ..... H01Q 1/243
9,379,449 B2 * 6/2016 Cetiner ..... H01Q 19/005
9,484,631 B1 * 11/2016 Napoles ..... H01Q 1/243
2002/0113737 A1 8/2002 Brachat
2004/0145526 A1 * 7/2004 Puente Baliarda .... H01Q 1/246 343/700 MS
2009/0231226 A1 * 9/2009 Quan ..... H01Q 1/085 343/770
2009/0322611 A1 12/2009 Manasson et al.
2010/0171674 A1 * 7/2010 Henderson ..... H01Q 13/08 343/778
2014/0176082 A1 * 6/2014 Visser ..... H01Q 1/248 320/137
2014/0368395 A1 * 12/2014 Dauguet ..... H01Q 1/246 343/798
2016/0134004 A1 * 5/2016 Haluba ..... H01P 5/12 455/12.1

OTHER PUBLICATIONS

Extended European Search Report, EP Appl No. 16828402.4; PCT/US2016/042911; dated Mar. 19, 2019.

* cited by examiner

| $\Phi_0$ | $\Delta\Phi_1$ | $\Delta\Phi_2$ | $\Delta\Phi_3$ | $\Delta\Phi_4$ |
|---|---|---|---|---|
| 30° | 0° | 90° | 180° | 270° |
| -30° | 270° | 180° | 90° | 0° |

Table 1

MONOLITHIC DUAL BAND ANTENNA

CROSS-REFERENCE TO RELATED APPLICATIONS

This application claims the benefit of U.S. provisional patent application No. 62/194,552 filed Jul. 20, 2015, the disclosure of which is incorporated herein by reference in its entirety.

TECHNICAL FIELD

Embodiments of the present disclosure relate to antennas for digital wireless communications, and in particular, to a vertically stacked dual band antenna servicing a low frequency (LOW) band and a high frequency (HI) band.

BACKGROUND

Single band antennas typically take up significant real estate in a receiver/transmitter enclosure. With present day wireless mobile devices, there is a need to fit multiple antennas in approximately the same space previously occupied by a single antenna. Where two different frequency bands, and therefore two antennas are needed, if a difference in the center frequencies of two antennas is more than an octave (the higher frequency is twice the lower frequency), there is a need for two separate antennas, one for each receiver/transmitter. This will increase even more the space requirement in an enclosure. Unfortunately, related art antenna structures for mobile devices cannot fit two antennas operating in different frequency bands in the same enclosure.

SUMMARY

The above-described problems are addressed and a technical solution is achieved in the art by providing a monolithic dual band antenna. The monolithic dual band antenna includes a first layer comprising a high frequency band antenna. The monolithic dual band antenna further includes a second layer underlying the first layer. The second layer includes a low frequency band antenna. The geometry of the high frequency antenna relative to the low frequency antenna causes resulting electric fields of the high frequency band antenna to be orthogonal to the resulting electric fields of the low frequency band antenna. The low frequency band antenna may act as a ground for the high frequency band antenna.

The first layer may comprise a micro-strip array of patches capable of beam forming. The first layer may further include an array of tunable phase shifter integrated circuits coupled to corresponding ones of the micro-strip array of patches of the high frequency band antenna. The array of tunable phase shifter integrated circuits may be operable to form a beam using the micro-strip array of patches of the high frequency band antenna.

The second layer underlying the first layer may include a single micro-strip patch for the low frequency band antenna.

A third layer underlying the second layer may include a control circuit coupled to the array of tunable phase shifter located in the first layer. The array of phase shifters may be coupled to corresponding ones of the micro-strip array of patches of the high frequency band antenna.

BRIEF DESCRIPTION OF THE DRAWINGS

The present invention may be more readily understood from the detailed description of an exemplary embodiment presented below considered in conjunction with the following drawings.

DETAILED DESCRIPTION

Embodiments of the present disclosure describe a vertically stacked dual band antenna servicing a low frequency (LOW) band (e.g., 2.45 GHz) and a high frequency (HI) band (e.g., 20 GHz). The low frequency antenna may be a single micro strip patch. The high frequency antenna may be a multi-patch micro strip array capable of beam forming. The beam forming/direction of arrival may be effected by a voltage controlled phase shifter.

Figure 1:
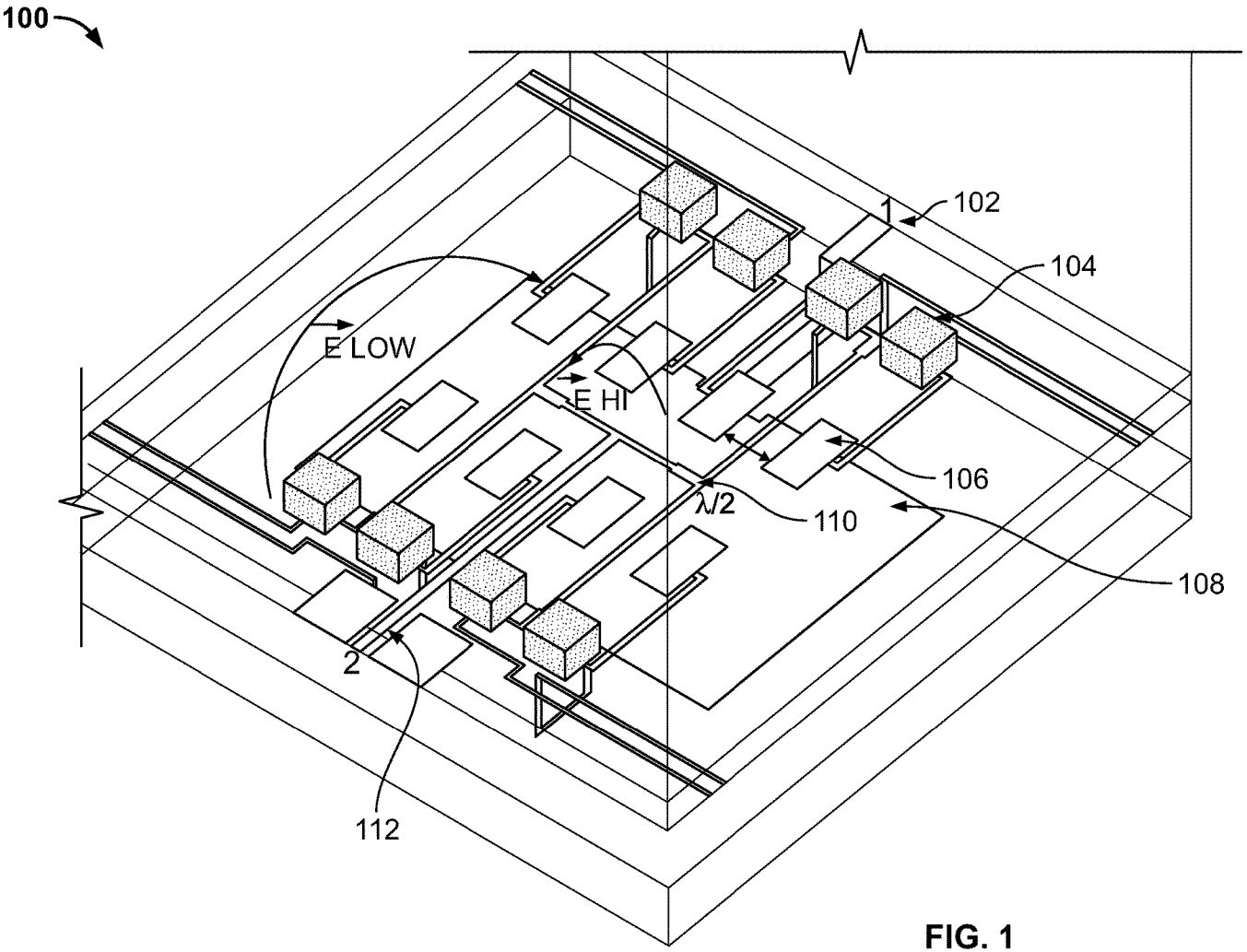
FIG. 1 shows a perspective three-dimensional view of one example of a dual band antenna.

FIG. 1 shows a perspective three-dimensional view of one example of a dual band antenna 100 (a layer with a control circuit is not shown). The dual band antenna 100 may include a low frequency input terminal 102, an array of tunable phase shifter integrated circuits 104, a corresponding array of a patches (e.g., 8 patches) of a high frequency band antenna 106, a low frequency band antenna 108, a feeder distribution line 110 for the array of the multi-patch high frequency band antenna 106, and a high frequency input terminal 112. The physical dimensions of the dual band antenna 100 may be selected to be 3.5 mm×7 mm for each of the high frequency patches (at 20 GHz) and 27 mm×40 mm for the low frequency patch (at 2.45 GHz).

Figure 2:
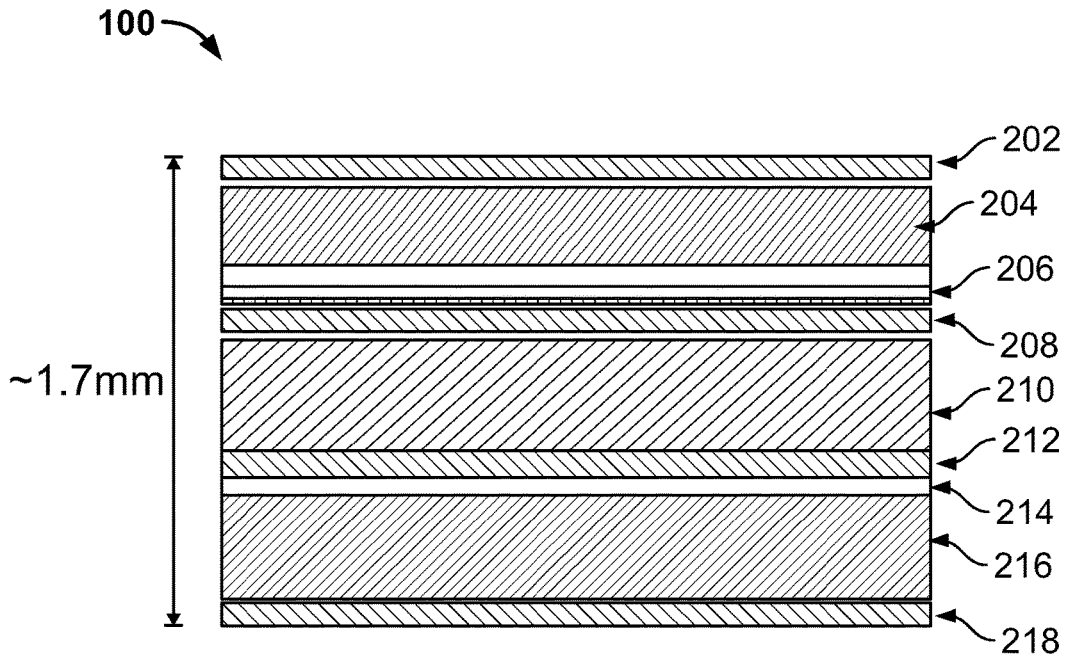
FIG. 2 shows a cross-sectional view of the dual band antenna of FIG. 1 arranged as a monolithic stack of layers.

FIG. 2 shows a cross-sectional view of the dual band antenna 100 of FIG. 1 arranged as a monolithic stack of layers. The top group of layers 202-206 may comprise the high frequency band antenna 106. The top layer (TOP) 202 may include the array of patches (e.g., 8 patches) of the high frequency band antenna 106. Layer 202 may also include the antenna feeder distribution line 110 and the tunable phase shifter integrated circuits 104 coupled to corresponding ones of the array of patches (e.g., 8 patches) for the high frequency band antenna 106. The tunable phase shifter integrated circuits 104 are responsible for beam forming with the array of patches (e.g., 8 patches) high frequency band antenna 106. Layer 202 may be a conductive layer.

Layer 204 may be a first dielectric layer for the array of patches (e.g., 8 patches) high frequency band antenna 106. In one example, the dielectric layer 204 may be a layer of FR4 material about 0.5 mm thick with a relative dielectric permittivity of about 3.8 (the antenna frequency band and the size of the patch depend on this constant). The layer 206 is a glue layer comprising two layers of glue of about 0.1 mm thickness each.

The middle group of layers 208-212 may be the layers comprising the low frequency band antenna substantially underlying the layers 202-206 comprising the high frequency band antenna 106. The layer 208 may hold the single patch for the low frequency band antenna 108. The layer 208 may also function as the ground layer for the array of patches (e.g., 8 patches) high frequency band antenna 106. The layer 208 may be metallized and may comprise a copper foil of about 30 microns thickness (the metallized foils of all such layers in the dual band antenna 100 may comprise copper foils of about 30 microns thickness). The layer 210 may be a second dielectric layer of FR4 material of about 1 mm thickness and may also have a dielectric relative permittivity of about 3.8. The bottom layer 212 may be metallized and may represent the ground plane for the low frequency band antenna 108.

The last group of layers 214-218 may hold a control circuit for the high frequency band antenna 106. The last group of layers 214-218 substantially underlays the middle group of layers 208-212 comprising the low frequency band antenna 108. The layer 214 is a glue layer of about 0.1 mm thickness. The layer 216 may be a third dielectric layer of FR4 material of about 1 mm thickness and may also have a dielectric relative permittivity of about 3.8. The bottom layer 218 may hold the electronic devices and the interconnections. The control circuit may connected to the phase shifters on the TOP layer 202 through vias (not shown). The layer 218 may be a conductive layer of about 0.1 mm thickness.

More particularly, all conductive layers are electrochemically deposited on the dielectric material. The glue layer 206 may be applied between the group of layers 202-204 and the group of layers 208-212. The glue layer 214 may be applied between group of layers 208-212 and the group of layers 216-218. The layer 206 may two-layers of glue while the layer 214 is one single layer. Each layer may be 0.1 mm thick.

In order to decouple the high frequency band antenna 106 from the low frequency band antenna 108, the geometry was selected such that the resulting electric fields of the high frequency band antenna 106 from the low frequency band antenna 108 may be orthogonal to each other as shown in FIG. 1.

The multiply-layer antenna configuration 100 saves significant real estate in a receiver/transmitter enclosure. The high frequency band antenna 106 may be configured to overly the low frequency band antenna 108, the latter acting as ground for the high frequency band antenna 106.

Figure 3:
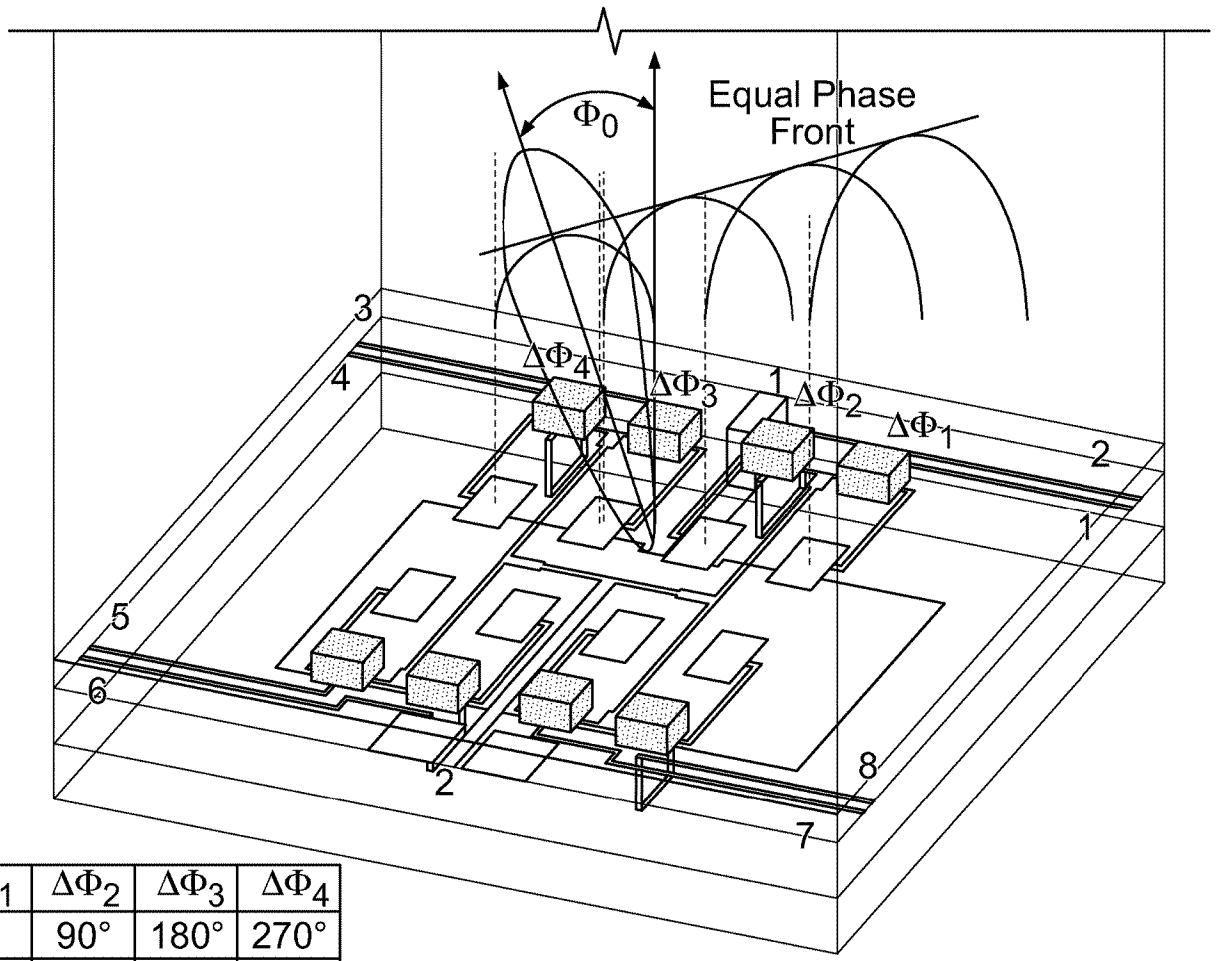
FIG. 3 shows how the array of patches of the high frequency band antenna may be tuned by the tunable phase shifter integrated circuits to form a beam.

FIG. 3 shows how the array of patches of the high frequency band antenna 106 may be tuned by the tunable phase shifter integrated circuits 104 to form a beam. The inputs 1, 2, 3, 4 shown in FIG. 3 are the control line inputs for a respective first half of the phase shifters of the voltage-controlled phase shifter integrated circuits 104, while the inputs 5, 6, 7, 8 shown in FIG. 3 are the control line inputs for a corresponding second half of the phase shifters of the voltage-controlled phase shifter integrated circuits 104 (See FIG. 9). The phase shift for each patch is depicted in Table 1 of FIG. 3. Table 1 shows the value of the angle Φo depends on each specific value of individual mini-patch phases.

Applying different voltages on the inputs phase shifter integrated circuits 104 result different phase shifts per patch antenna. For a certain combination of phase shifts, the high frequency band antenna 106 may transmit maximum power or receive maximum power in a particular direction.

The high frequency band antenna 106 may be composed of 8 mini patch antennas. Each one of the mini patch antennas may be fed via a phase shifter connected through a micro-strip. These 8 antennas may behave as a single antenna having one single radiating lobe (8 mini-lobes composed in one single larger lobe). If the microwave phase on each of mini antennas is different from the others, the resulting lobe may be bent by an angle Φo depending on the microwave phase value ΔΦi on each of the mini-patches.

Figure 4:
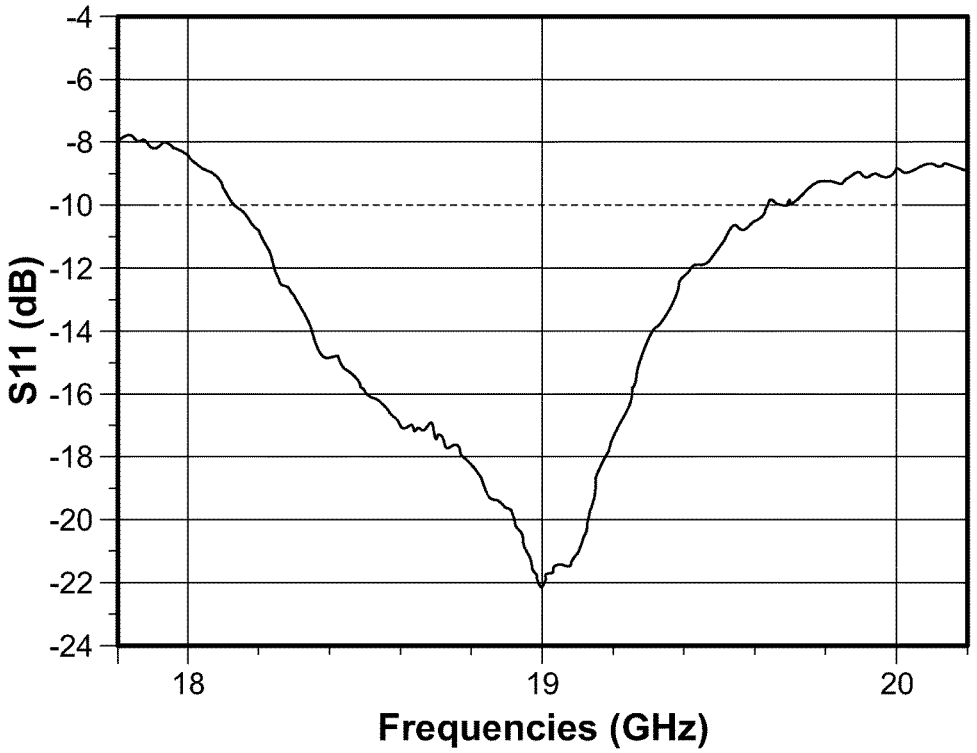
FIG. 4 shows a plot of S11—reflection loss versus frequency for the High frequency band antenna of FIGS. 1 and 2.
Figure 5:
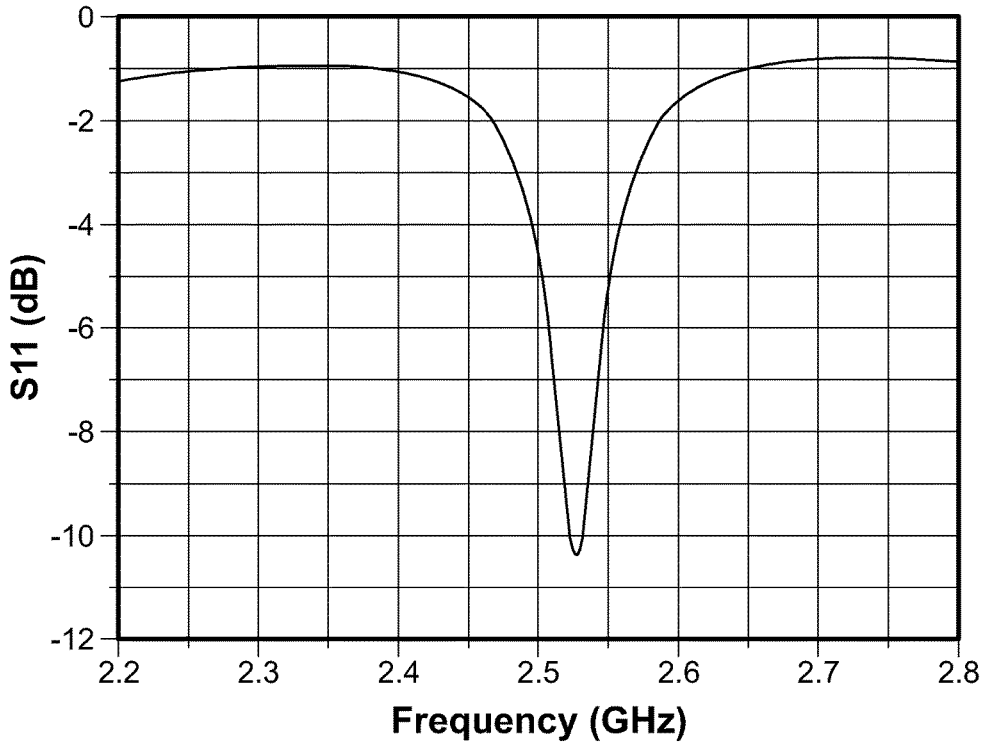
FIG. 5 shows a plot of S11—reflection loss versus frequency for the low frequency band antenna of FIGS. 1 and 2.

FIGS. 4 and 5 show plots of two-port system S-parameters. More particularly, FIG. 4 shows a plot of S11—reflection loss versus frequency for the high frequency band antenna 106, while FIG. 5 shows a plot of S11—reflection loss versus frequency for the low frequency band antenna 108. ($S_{11}$ is the input port voltage reflection coefficient; $S_{12}$ is the reverse voltage gain; $S_{21}$ is the forward voltage gain; and $S_{22}$ is the output port voltage reflection coefficient).

Figure 6:
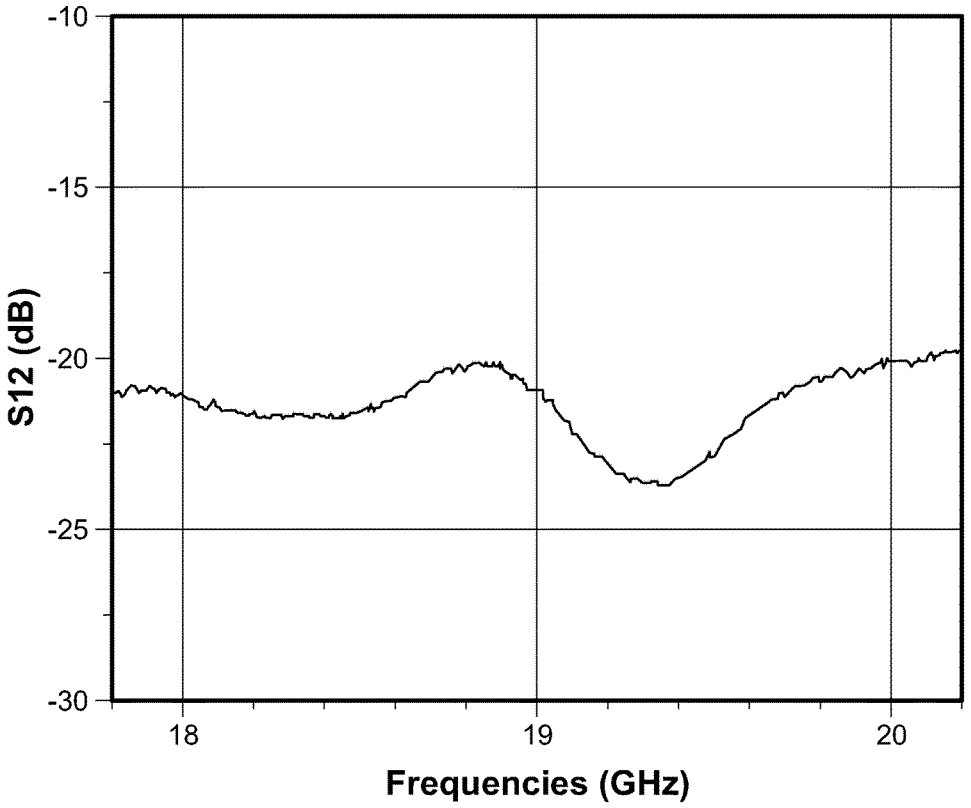
FIG. 6 is a plot of S12 reverse gain versus frequency between the high frequency band antenna and the low frequency band antenna.

FIG. 6 is a plot of S12 reverse gain versus frequency between the high frequency band antenna 106 and the low frequency band antenna 108. FIG. 6 illustrates the relative decoupling of the high frequency band antenna 106 and the low frequency band antenna 108. FIG. 6 shows that the decoupling may be better than −20 dB.

Figure 7:
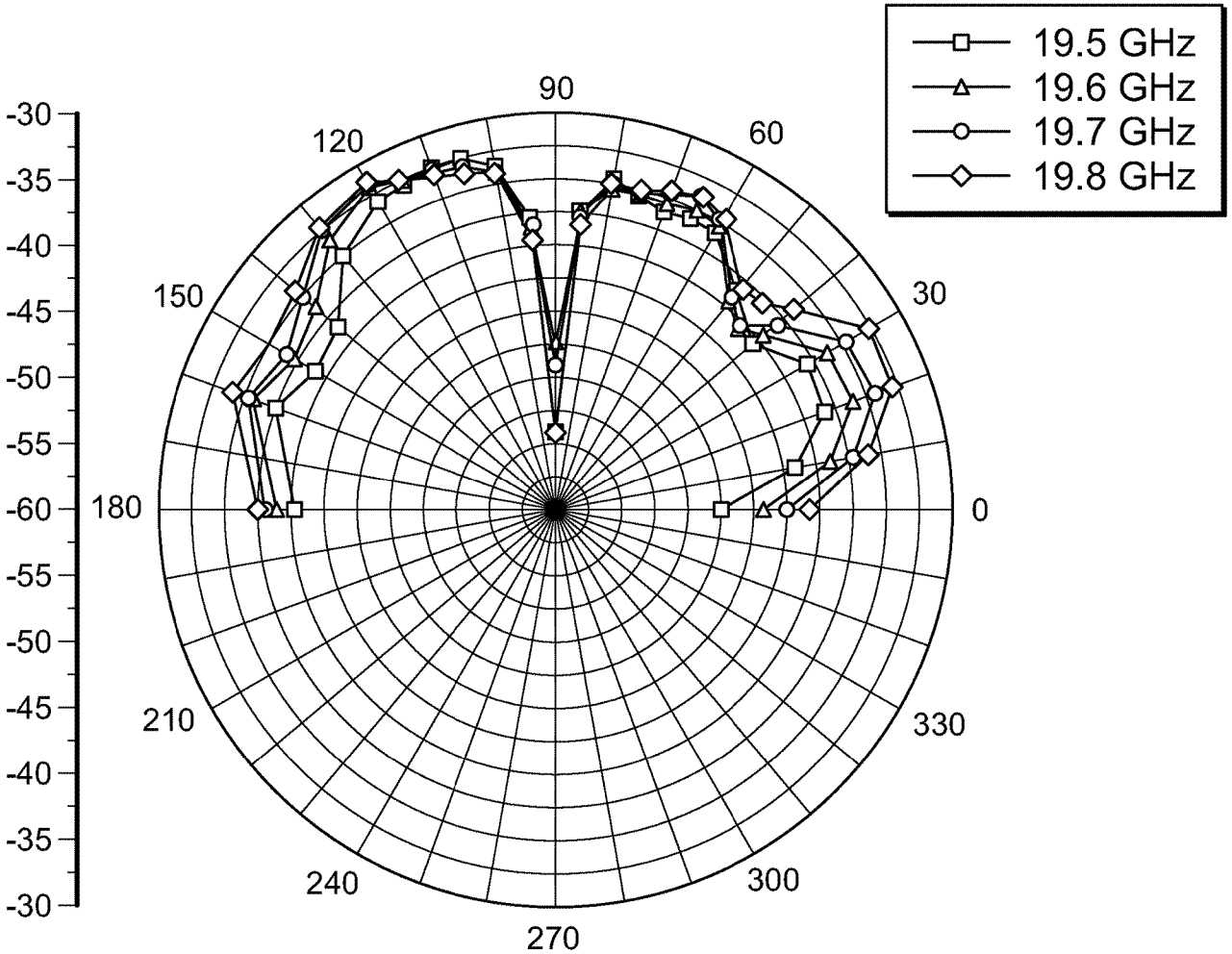
FIG. 7 is a transmission polar diagram for four different frequencies in the antenna passband.
Figure 8:
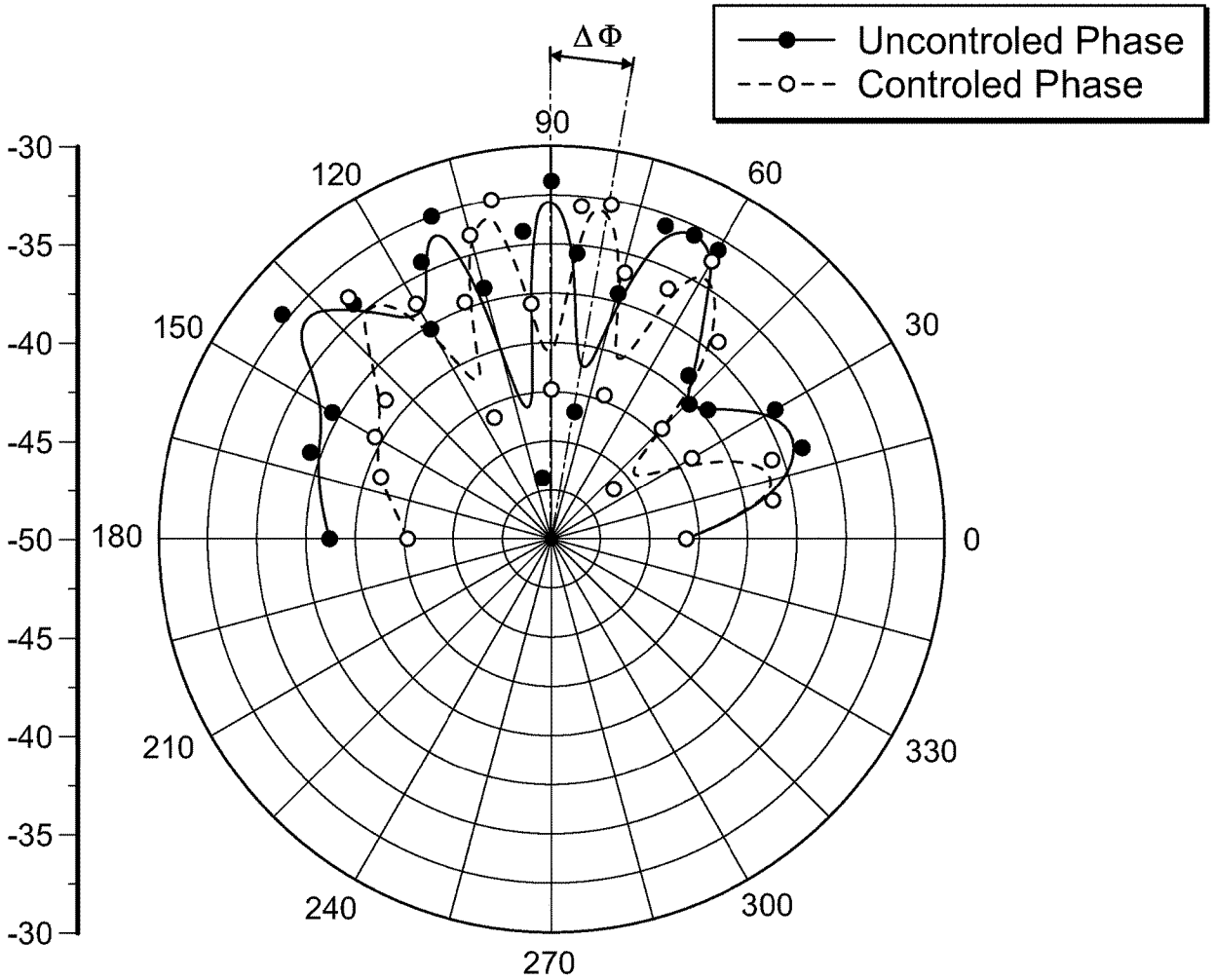
FIG. 8 show a plot illustrating an example of beam control at 19 GHz, $\Delta\Phi \sim 10°$.

FIG. 7 is a transmission polar diagram for four different frequencies in the antenna passband (S12 as a function of angle for uncontrolled phase shifters). FIG. 8 show a plot illustrating an example of beam control at 19 GHz, ΔΦ~10°. FIG. 8 further shows one example of directivity shift with 10 degrees.

Figure 9:
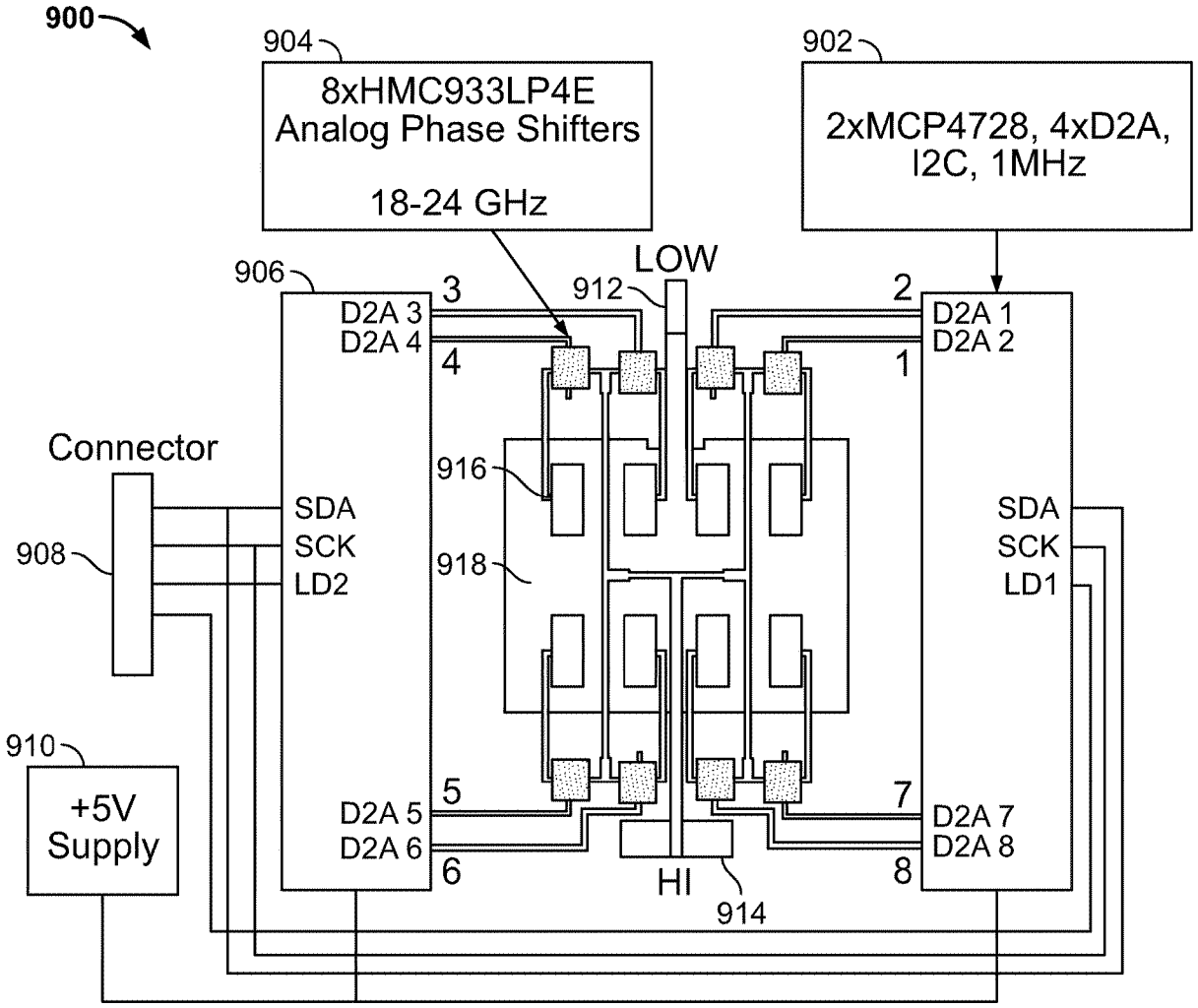
FIG. 9 is a schematic block diagram of the phase shifters control circuit of FIGS. 1 and 2.

FIG. 9 is a schematic block diagram of the phase shifters control circuit 900. The phase shifters control circuit 900 may include a pair of digital-to-analog voltage converters 902, 906 (e.g., MCP4728, I2C, operating at 1 MHz), an array of analog voltage-controlled phase shifters 904 (e.g., MCP933LP4E, operating at 18-24 GHz) coupled to the corresponding array of patches 916 of the high frequency band antenna 106, a connector for serial digital input control of the digital-to-analog voltage converters 902, a +5V DC voltage supply 910 for powering the digital-to-analog voltage converters 902, 906 and the array of analog voltage-controlled phase shifters 904, an input terminal 912 coupled to the low frequency band antenna 108, 918 and a HI input terminal 914 coupled to the high frequency band antenna 106, 916.

As noted above, the phase shifters control circuit 900 may include two programmable serial interface digital to analog (D to A) converters 902, 906, respectively, having four analog outputs each (3, 4, 5, 6 and respectively 1, 2, 7, 8). The control logic may include a serial data input (SDA), a serial clock input (SCLK) and a load (LD) input coupled to a microcontroller/processor (not shown) through the connector 908. The D to A converters 902, 906 may be supplied with 5 V from a low noise power supply 910 and may share the same serial (I2C) control bus.

In operation, serialized digital values corresponding to phase shift voltages are input over the I2C bus by the microprocessor through the connector 908 to the D to A converters 902, 906, the latter applying corresponding voltages representing corresponding phase shifts to be applied to the corresponding voltage-controlled phase shifters 904 to control the beam forming of the patches of the high frequency band antenna 106.

Figure 10:
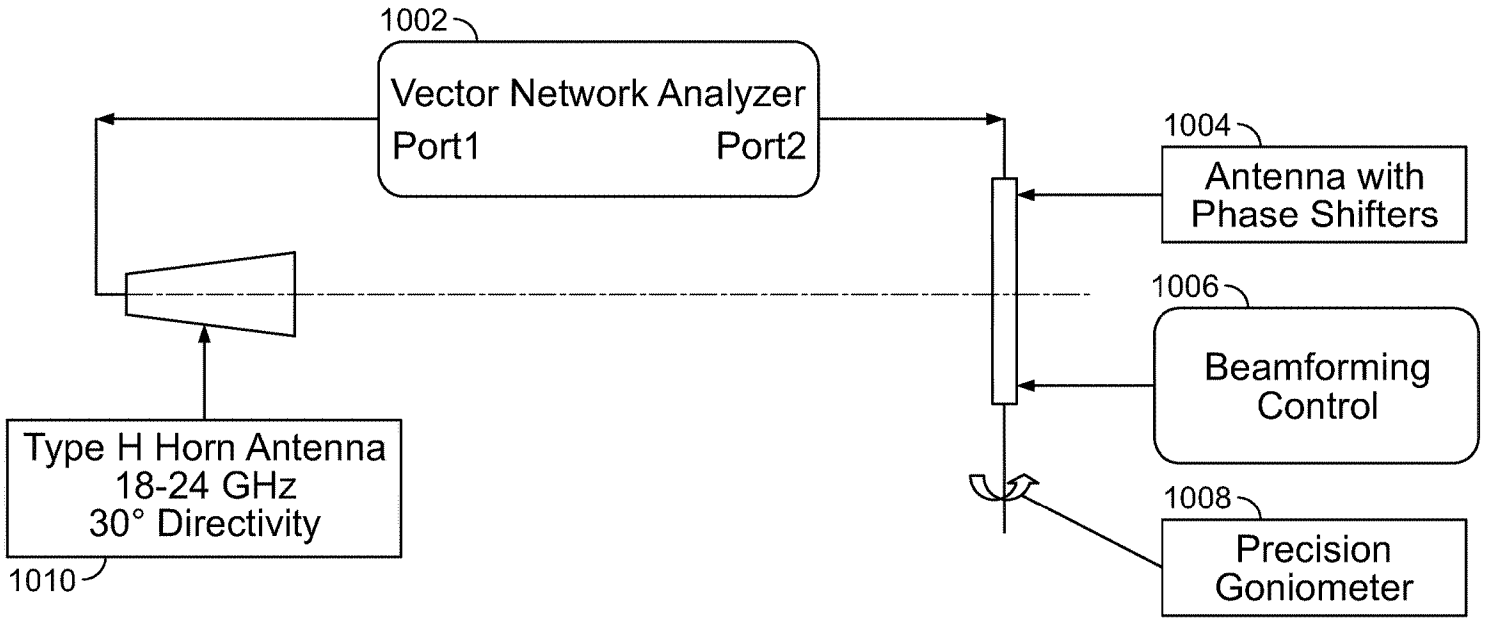
FIG. 10 is a schematic block diagram of an apparatus for measuring S parameters.

FIG. 10 is a schematic block diagram of an apparatus for measuring S parameters. measurement block diagram. To measure the S parameters, the key instrument is a vector network analyzer (VNA) 1002 operating over the desired frequency bands. In the measurement block diagram of FIG. 10, the test antenna (antenna with phase shifters) 1004 is connected to the Port 2 of the VNA 1002. The test antenna 1004 is mounted on a precision goniometer 1008. The phase shifter control circuit is connected to a programmed computer (not shown) via a digital interface. Port 1 of the VNA 1002 is connected to an H type horn antenna 1010 with the following parameters: frequencies band 18-24 GHz, directivity 30°. The distance between the horn antenna 1010 and the test antenna 1004 is 22 cm. The VNA 1002 measures the transmission between antennas 1004, 1010 (S12 and S21, S12=S21 in this case) and the reflection from the antenna 1004 on each port (S11, S22). To measure beam forming capability of the antenna 1004, the following procedure was used.

The test antenna 1004 is the emitter, while the horn antenna 1010 is the receiver. The transmission coefficient S21 from the emitter 1004 to the receiver 1010 is measured and saved on the VNA screen. Without control, S21 represents a reference (Φo=0). The beam forming control unit 1006 sets the phase shifters values and the precision goniometer 1008 rotates the test antenna 1004 until a maximum is detected. This is how the FIG. 8 diagram is obtained.

Figure 11:
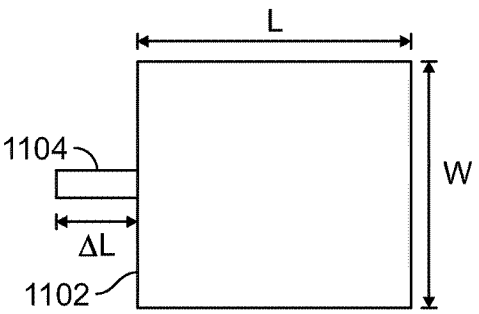
FIG. 11 shows a diagram illustrating how to calculate desired dimension of length L and width W of the single patch low frequency band antenna of FIG. 1.

FIG. 11 shows a diagram illustrating how to calculate desired dimension of length L and width W of the single patch low frequency band antenna 108 of FIG. 1. The micro-strip patch antenna dimensions calculation steps are as follows:

Step 1: Calculation of the Width (W)—

$$W = \frac{c}{2f_o\sqrt{\frac{(\varepsilon_r+1)}{2}}}$$

Step 2: Calculation of the Effective Dielectric Constant. This is based on the height, dielectric constant of the dielectric and the calculated width of the patch antenna.

$$\varepsilon_{eff} = \frac{\varepsilon_r+1}{2} + \frac{\varepsilon_r-1}{2}\left[1+12\frac{h}{W}\right]^{-\frac{1}{2}}$$

Step 3: Calculation of the Effective Length $$L_{eff} = \frac{c}{2f_o\sqrt{\varepsilon_{eff}}}$$

Step 4: Calculation of the Length Extension ΔL (1104)

$$\Delta L = 0.412h\frac{(\varepsilon_{eff}+0.3)\left(\frac{W}{h}+0.264\right)}{(\varepsilon_{eff}-0.258)\left(\frac{W}{h}+0.8\right)}$$

Step 5: Calculation of Actual Length of the Patch $$L=L_{eff}-2\Delta L$$

where the following parameters are used:

$f_0$ is the resonance frequency

W is the width of the patch

L is the length of the patch h is the thickness $\varepsilon_r$ is the relative permittivity of the dielectric substrate c is the Speed of light: $3\times10^8$ In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The disclosure also relates to an apparatus for performing the operations herein. This apparatus may be specially constructed for the required purposes, or it may include a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

Whereas many alterations and modifications of the disclosure will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims, which in themselves recite only those features regarded as the disclosure.

What is claimed is:

1. A monolithic dual band antenna, comprising:

a first layer comprising a high frequency band antenna to generate a first electric field, wherein the high frequency band antenna comprises an array of patch antennas, each patch antenna being associated with a beam phase-tuned using a corresponding tunable phase shifter integrated circuit based on an input voltage, and wherein each beam associated with the corresponding patch antennas is characterized by a respective mini-lobe for composing a single lobe of the high frequency band antenna; and a second layer underlying the first layer, the second layer comprising a low frequency band antenna to generate a second electric field, wherein a geometry of the high frequency antenna relative to the low frequency antenna causes the first electric field generated by the high frequency band antenna to be orthogonal to the second electric field generated by the low frequency band antenna.

2. The antenna of claim 1, wherein the high frequency band is in a range of 18 GHz to 20 GHz and the low frequency band is in a range of 2.2 GHz to 2.8 GHz, and wherein the low frequency band antenna acts as a ground for the high frequency band antenna.

3. The antenna of claim 1, wherein the first layer comprises the array of patch antennas capable of beam forming.

4. The antenna of claim 1, wherein the first layer further comprises an antenna feeder distribution line.

5. The antenna of claim 1, wherein the tunable phase shifter integrated circuits are to form a beam of the array of patch antennas of the high frequency band antenna.

6. The antenna of claim 1, wherein the second layer comprises a single micro-strip patch for the low frequency band antenna.

7. The antenna of claim 6, wherein the second layer further comprises:

a metallized copper foil layer;

a dielectric layer of FR4 material underlying the metallized copper foil layer; and a metallized bottom layer underlying the dielectric layer forming the ground plane for the low frequency band antenna.

8. The antenna of claim 7, wherein the metallized copper foil layer is about 30 microns in thickness.

9. The antenna of claim 7, wherein, the dielectric layer is about 1 mm in thickness and has a dielectric relative permittivity of about 3.8.

10. The antenna of claim 1, further comprising a third layer underlying the second layer, the third layer comprising a control circuit for the high frequency band antenna.

11. The antenna of claim 10, wherein the control circuit is coupled to an array of tunable phase shifter integrated circuits located in the first layer, wherein the array of phase shifter integrated circuits are coupled to corresponding ones of the array of patch antennas of the high frequency band antenna.

12. The antenna of claim 10, wherein the third layer further comprises:

a glue layer;

a dielectric layer of FR4 material underlying the glue layer; and a layer underlying the dielectric layer comprising the control circuit.

13. The antenna of claim 12, wherein the glue layer is about 0.1 mm in thickness and has a dielectric relative permittivity of about 3.8.

14. The antenna of claim 12, wherein the layer comprising the control circuit is a conductive layer of about 0.1 mm thickness.

15. The antenna of claim 1, wherein the first layer further comprises:

a conductive layer;

a dielectric layer for the array of patch antennas of the high frequency band antenna, the dielectric layer underlying the conductive layer; and a glue layer underlying the dielectric layer.

16. The antenna of claim 15, wherein the glue layer comprises two layers of glue of about 0.1 mm thickness each and the dielectric layer is a layer of FR4 material about 0.5 mm thick with a relative dielectric permittivity of about 3.8.

17. The antenna of claim 1, wherein the first layer, the second layer, and a third layer are electrochemically deposited on a dielectric material.

18. A method, comprising:

providing a monolithic dual band antenna] comprising:

a first layer comprising a high frequency band antenna to generate a first electric field, wherein the high frequency band antenna comprises an array of patch antennas, each patch antenna being associated with a beam phase-tuned using a corresponding tunable phase shifter integrated circuit based on an input voltage, and wherein each beam associated with the corresponding patch antennas is characterized by a respective mini-lobe for composing a single lobe of the high frequency band antenna; and a second layer underlying the first layer, the second layer comprising a low frequency band antenna to generate a second electric field, wherein a geometry of the high frequency band antenna relative to the low frequency band antenna to cause the first electric field generated by the high frequency band antenna to be orthogonal to the second electric field generated by the low frequency band antenna.

19. The method of claim 18, wherein the high frequency band antenna comprises the array of patch antennas, and wherein providing the monolithic dual band antenna further comprises providing an array of tunable phase shifter integrated circuits coupled to corresponding ones of the array of patch antennas of the high frequency band antenna, and further comprising:

forming, using the tunable phase shifter integrated circuits, a beam using the array of patch antennas of the high frequency band antenna.

* * * * *